United States Patent [19]

Yamada

[11] Patent Number: 4,489,767

[45] Date of Patent: Dec. 25, 1984

[54] APPARATUS FOR DROPPING LIQUEFIED GASES

[75] Inventor: Morio Yamada, Yokohama, Japan

[73] Assignee: Toyo Seikan Kaisha, Ltd., Japan

[21] Appl. No.: 383,319

[22] Filed: May 28, 1982

[30] Foreign Application Priority Data

Sep. 8, 1981 [JP] Japan ..... 56-140252
Nov. 20, 1981 [JP] Japan ..... 56-185510

[51] Int. Cl.[3] ..... B65B 3/04

[52] U.S. Cl. ..... 141/48; 141/82; 141/91; 141/98; 141/286; 141/95

[58] Field of Search ..... 141/1-12, 141/37-67, 89, 90, 91, 82, 286, 129-191, 83, 98; 53/281, 510

[56] References Cited

U.S. PATENT DOCUMENTS 3,670,786 6/1972 Levin et al. ..... 53/510
4,077,182 3/1978 Papaluca ..... 53/281

*Primary Examiner*—Houston S. Bell, Jr.

*Attorney, Agent, or Firm*—Jordan B. Bierman

[57] ABSTRACT

Apparatus for dropping and sealing liquefied inert gases into a can immediately before rolling of a canning can, and applying internal pressure to the can after sealed. Liquefied gases supplied from a liquefied gas main tank to a liquefied gas storage tank set in gas pressure lower than that of the main tank is controlled by a bucket or ball type float valve to maintain a constant liquid level at all times. A given amount of liquefied gases are dropped from a dropping nozzle into a can by means of a dropping valve actuated by a sensing signal of the can. Internal pressure of the storage tank is maintained constant by releasing vaporized gases within the tank through a regulating valve. This released gas shields the liquefied gases released and dropped towards the circumference of the dropping nozzle and the nozzle to prevent vaporization of the dropping gases and freezing of the nozzle. To prevent the nozzle from being frozen, it is preferred that a nozzle portion is made of a suitable synthetic resin.

12 Claims, 9 Drawing Figures

APPARATUS FOR DROPPING LIQUEFIED GASES

BACKGROUND OF THE INVENTION

1. Field of the Invention

This invention relates to an apparatus for dropping and filling liquefied inert gases wherein the liquefied inert gases are dropped and filled into a canning can immediately before rolling thereof to generate given pressure within the canning can after sealed.

2. Description of the Prior Art

Even in canning of drinks and food not containing carbon dioxide gas, it is desired that cans manufactured of a material having a thin wall-thickness similar to cans for drinks containing carbon dioxide gas are used as containers.

Therefore, attempts have been made wherein the liquefied inert gases are dropped and filled into a can immediately before rolling thereof to increase internal pressure after sealed, thus making up for the shortage of the strength of the can made of a thin material. However, the quantity of liquefied inert gases to be dropped and sealed varies with the temperature of material to be filled, the operating speed of the rolling device, the magnitude of the space in the upper portion within the can, etc.

The inert gas dropping device is provided with a storage tank for liquefied inert gases and a dropping nozzle, and in order to accurately control the aforesaid quantity of dropping, it is necessary to control the quantity of the liquefied gases to be supplemented into the storage tank.

The simplest way considered is that the storage tank for liquefied gases is interiorly provided with a float so that the float may be moved up and down to deviate the liquefied gas to cause fluctuation of internal pressure, by which change in said pressure the liquefied inert gases may flow into the storage tank from a liquefied gas cylinder.

However, it is difficult to always prevent the pressure within the storage tank from acting on the liquefied gas flowing downwardly from the dropping nozzle, and therefore, the quantity of dropping is difficult to to be controlled by the dropping device of the system as described.

The present inventor has proposed that in order to provide a precise control of the dropping quantity of liquefied gases, a storage tank is interiorly provided with a level gauge so that with the value detected thereby, the supplemented quantity of liquefied gases is controlled by means of an electromagnetic valve or the like, and on the other hand, with the regulation of pressure within the tank, main adjustment of the dropping quanity is finely made by the valve attached to the dropping nozzle.

This dropping device is precise in control of the dropping quantity but has a drawback in that the control device is complicated and expensive.

SUMMARY OF THE INVENTION

The present invention provides an apparatus for dropping liquefied inert gases into a can immediately before rolling the canning can, comprising a storage tank for liquefied inert gases, a valve for dropping liquefied gases opened and closed by a driving device, a nozzle plate for dropping liquefied gases from said dropping valve, a gas nozzle for releasing vaporized gases in a space in the upper portion of the storage tank through an internal pressure regulating valve, and a bucket or ball type float valve for opening and closing a liquid feed port for liquefied gases from a main tank to said storage tank, said apparatus being capable of precisely controlling the dropping quantity despite a simple control device. The liquid may be fed to the storage tank only according to a level of liquefied gases within the storage tank irrespective of internal pressure in the main tank to enable continuous and stable supply of liquid and to maintain a liquid level constant. If the internal surface of the storage tank is coated with TEFLON, temporary heat-insulating effect may be obtained to shorten the preparation time required till the operation is started. If the nozzle plate of the dropping valve and accessories thereof are formed of resins, it is possible not only to prevent the frost from being deposited on the surface of the nozzle plate but to prevent the nozzle hole from being freezed. Since it is designed so that the vaporized gases are guided to and blown from the outer peripheral portion of the nozzle plate, not only the cooling effect of liquefied gases may be obtained but frosting (freezing) may be prevented. A control circuit for dropping liquefied gases is provided to sense the passage of cans so that the dropping valve is automatically actuated for every can to drop and seal the adjusted amount of liquefied gases into the can in a manner such that if the delivery speed of cans increases, continuous dropping is effected. In this case, if the pressure erasing nozzle is mounted on the nozzle plate, it is possible to prevent the liquefied gases from the dropping nozzle from being impinged upon the liquid surfaces within the can and scattered therefrom. If it is designed so that the vaporized gases within the storage tank are guided into the electromagnetically drived device, the electromagnetic coil may be cooled to prevent burning thereof.

DETAILED DESCRIPTION OF THE PREFERRED EMBODIMENTS

Figure 1:
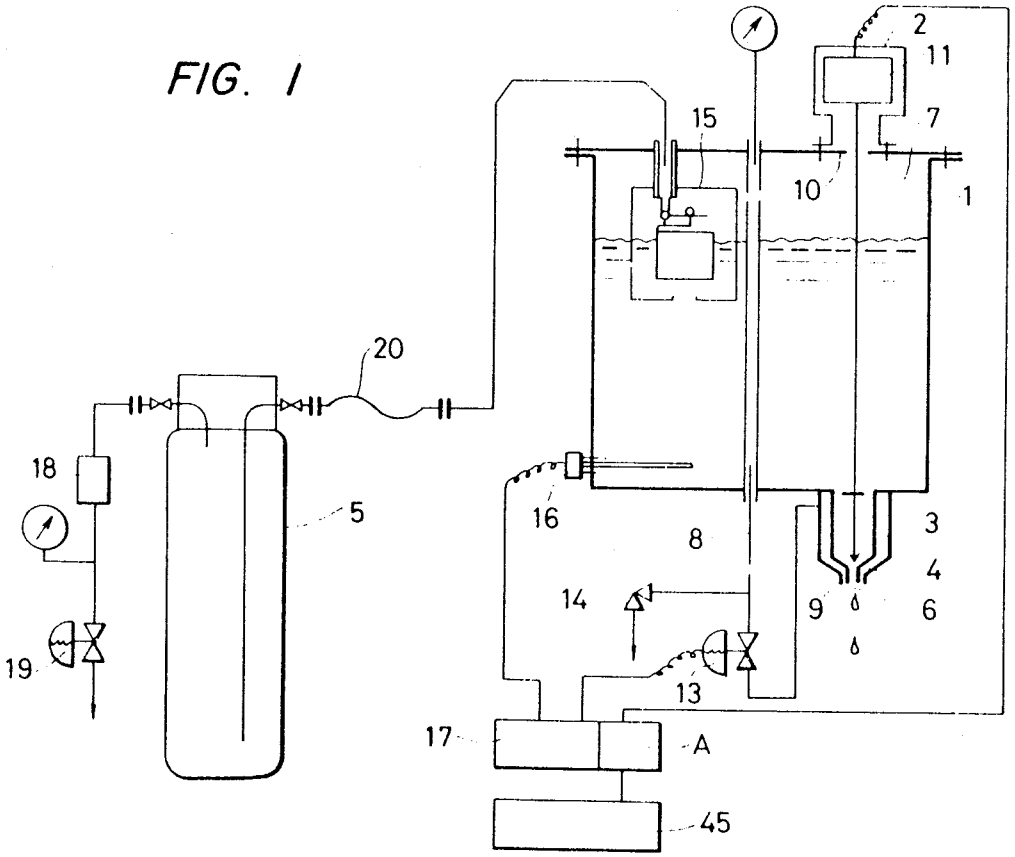
FIG. 1 is a schematic view of one embodiment of a liquefied inert gas dropping apparatus in accordance with the present invention.

FIG. 1 is a schematic view of a liquefied inert gas dropping apparatus in accordance with the present invention. In FIG. 1, a liquefied inert gas storage tank 1 which is heat-insulated by a heat insulating material (such as foamed styrene) or the like is provided with a dropping valve 3 such as a needle valve or a rotary valve or the like for adjusting the dropping quantity of liquefied gases by means of an electromagnetically-driven device 2 and a nozzle plate 4. The internal surfaces of the storage tank 1 is teflon-coated in order that when the liquefied inert gases are initially fed from a main tank 5, abrupt vaporization and pressure rise are restrained till the temperature of the storage tank 1 is sufficiently lowered to early stabilize the internal pressure of the tank, thus shortening the liquid feed preparation time to save liquefied gases.

The nozzle plate 4 is provided in a central portion thereof with a dropping nozzle 6 for dropping liquefied gases, the whole structure thereof being formed of resin (for example, known as DAIFLON) to prevent frosts from being deposited on the surface and prevent the nozzle portion from being frozen.

The vaporized gases in a space 7 in the upper portion of the storage tank 1 are guided to the outer peripheral portion of the nozzle plate 4 through a discharge pipe line system 8 and discharged through a gas nozzle 9 so that the dropping liquefied gases are shielded by a low temperature inert gas to prevent the liquefied gases from being vaporized and frozen. On the other hand, vaporized gases are guided into the electromagnetically-driven device 2 through a vaporized gas guide port 10 to cool a solenoid 11 thus preventing burns or the like. Also, the discharge pipe line system 8 is provided with an internal pressure regulating valve 13 and a safety valve 14 to regular internal pressure of the storage tank 1. Surplus gases are guided from an unillustrate separate pipe line system to a seamer rolling section to utilize said gases as under-cover gassing gases adapted to reduce the amount of air sealed into the can.

A liquid feed section into the storage tank 1 is provided with a bucket or ball type float valve 15 so that an opening of the valve is automatically adjusted in response to a liquid level to always maintain the liquefied level constant, whereby the liquid level is stabilized and liquids may be fed continuously. Since the bucket or ball type float valve 15 is operated irrespectively of change in design of presure of the storage tank 1, only the gas pressure within the storage tank 1 may be controlled to effectively save the gases. A heater for retaining in-tank pressure is provided so that a control device 17 is actuated so that internal pressure of the storage tank may not be decreased to a level below the preset value to heat said heater for vaporization of liquefied gases. The internal pressure regulating valve 13 is open to let said vaporized gases continuously escape to retain the internal pressure of the storage tank 1 at the preset value. The main tank 5 is provided with an anti-freezing heater 18 and a pressure regulating valve 19 for setting internal pressure of the main tank 5. Reference numeral 20 designates a pipe line system for connecting the main tank 5 to the storage tank 1.

The internal pressure regulating valve 13 is set according to a predetermined amount of drops and a pressure regulating valve 19 is set so that internal pressure of the main tank 5 is higher than internal pressure of the storage tank 1 determined by said setting of the valve 13, after which the storage tank 1 and the main tank 5 are connected by the pipe line system 20, then the liquefied inert gases flow into the storage tank 1 under the influence of pressure of the main tank 5. When the liquid within the storage tank 1 reaches a given level, the bucket or ball type float valve 15 causes to stop inflow of liquefied gases, after which a liquid level is maintained irrespective of the change in internal pressure of the storage tank 1 lower than internal pressure of the main tank 5 to automatically feed the liquefied gases in the amount corresponding to consumption.

Figure 2:
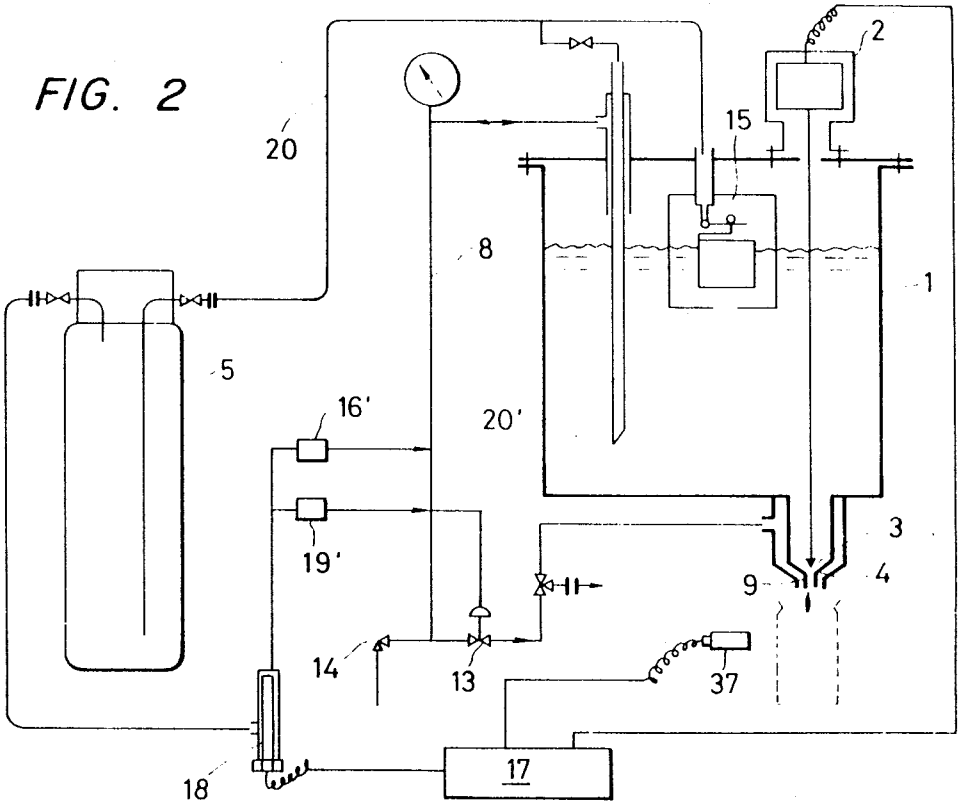
FIG. 2 is a schematic view of another embodiment of the liquefied inert gas dropping apparatus in accordance with the present invention.

FIG. 2 shows a further embodiment. The whole structure of the liquefied gas dropping apparatus shown in FIG. 2 is substantially the same as the embodiment of FIG. 1, like reference numerals designating like or corresponding parts.

In this embodiment, a quick charge pipe 20' is provided coaxial with the discharge pipe to speed up an initial feed of liquids to the storage tank 1. Internal pressure of the storage tank 1 is not retained by the heater but is retained by making use of internal pressure of the main tank 5 set higher than the internal pressure of the storage tank 1. Therefore, the internal pressure of the main tank 5 is connected to the discharge pipe line 8 through a regulator 16' so that when the internal pressure of the storage tank decreases, pressure exerts on the storage tank conversely from the discharge pipe line. The internal pressure of the main tank 5 is likewise maintained constant by a pressure control regulator 19'. In the piping of this embodiment, the discharged gases from the main tank 5 merge with the discharged gases from the storage tank 1 and are discharged as shield gases through the gas nozzle 9. In FIG. 2, reference numeral 37 denotes a sensor for cans into which liquefied gases are dropped.

Figure 3:
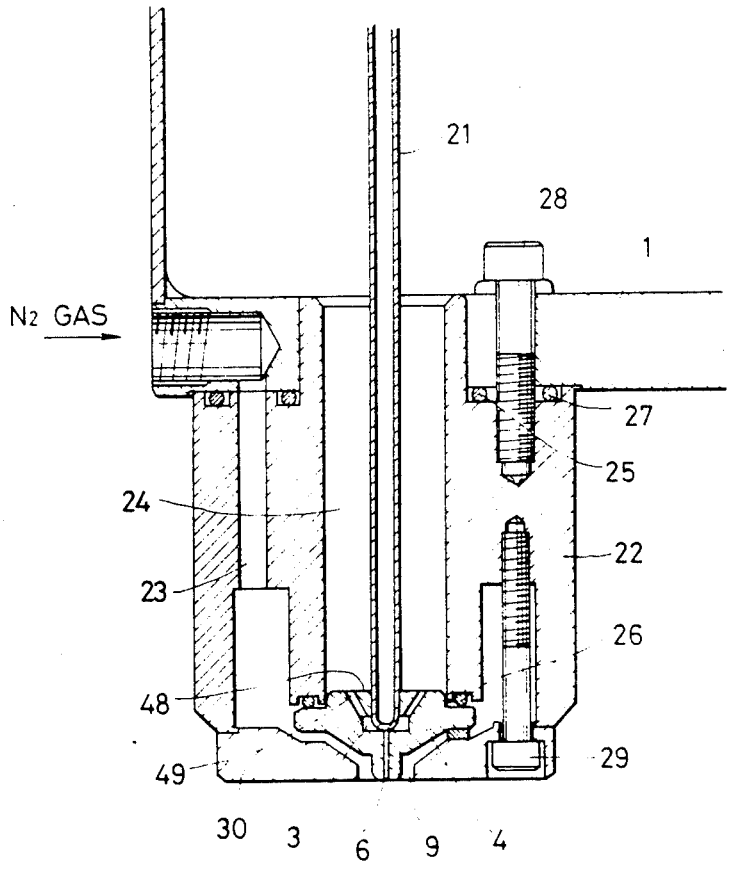
FIG. 3 is an enlarged sectional view of one embodiment of a dropping valve and a nozzle plate portion in accordance with the present invention.

FIG. 3 is an enlarged view showing a dropping valve 3 and a nozzle plate 4. A valve rod 21 is formed at the forward end thereof with a needle of the dropping valve 3 and the other end thereof comprising a valve rod connected to a solenoid 11. A block 22 which is coated with TEFLON has a gas guiding passage 23 provided in the neighbourhood of an outer peripheral portion thereof to guide vaporized gas fed through the discharge pipe line system 8 to the gas nozzle 9 and has a storage chamber 24 provided on the central portion thereof to store liquefied gases in the storage tank 1. Reference numerals 25, 26 designate O-rings made of resin (for example, known as DAIFLON), 27 an O-ring made of TEFLON or silicone, 28 a bolt for securing the block 22 to the storage tank 1, and 29 a bolt for securing a gas nozzle part 30 to the block 22. The valve rod 21 is inserted into the central portion in the upper surface of the nozzle plate 4 to constitute a needle valve, and communicating holes 49 for supplying liquids from the liquefied gas storage chamber 24 to the nozzle are provided in the periphery of a hole 48 serving as a guide for the valve rod 21 when the valve is open and closed so that flows of liquids issued from these communicating holes impinge upon one another to weaken the flow velocity thereof and they flow down through the nozzle 6.

Figure 4:
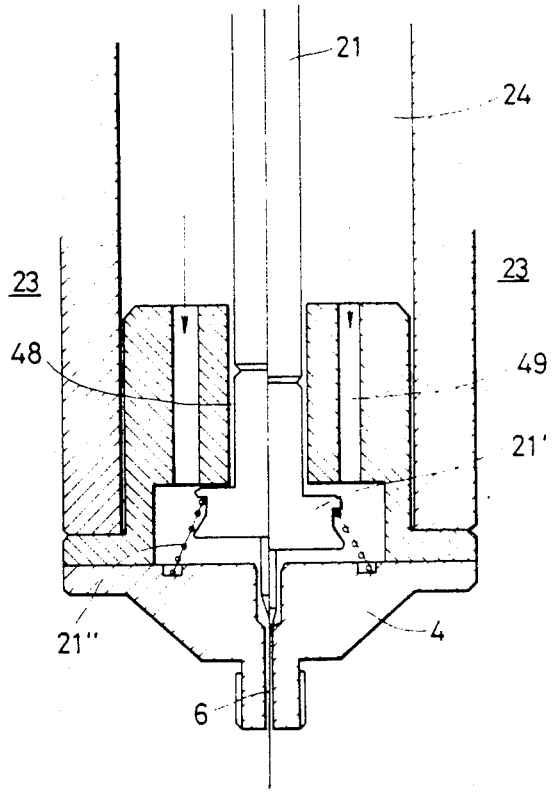
FIG. 4 is also an enlarged sectional view of another embodiment of the dropping valve and the nozzle plate portion.

FIG. 4 shows an embodiment in which a needle valve 21' at the forward end of the valve rod 21 is formed separately from the valve rod 21. In FIG. 4, the right half portion taken from the center line shows the state where the valve rod 21 is moved down to close the valve whereas the left half portion thereof shows the state where the valve rod 21 is moved up to open the valve so that the liquefied gas passes through the communicating hole 49 and drops from the nozzle 6. Reference numeral 21'' denotes a push-up spring to allow the needle valve 21' to follow upward movement of the valve rod 21.

If the valve rod 21 is formed separately from the needle valve 21' as described hereinbefore, there provides an advantage in that the needle valve 21' may be readily centered with the valve seat.

Figure 5:
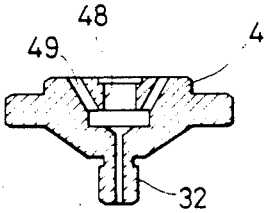
FIG. 5 is an enlarged sectional view of a further embodiment of the nozzle plate.
Figure 6:
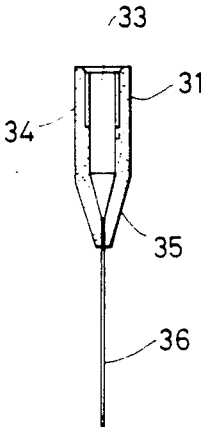
FIG. 6 is a sectional view of a pressure erasing nozzle.

FIG. 5 shows the other embodiment of a nozzle plate 4' in which said nozzle plate 4' is formed in the outer peripheral portion on the lower end thereof with tapped slots 32 for detachably mounting a pressure erasing nozzle 31 shown in FIG. 6. The aforesaid pressure erasing nozzle 31 is provided to prevent an occurrence of unevenness in dropping quantity resulting from liquefied gases from the dropping nozzle 6 impinging upon and scattered from the liquid surfaces within the can, said pressure erasing nozzle being formed of a sintered alloy. The pressure erasing nozzle 31 has an upper opening 33 formed with tapped slots 34 in engagement with the tapped slots 32 of the nozzle plate 4'. The pressure erasing nozzle 31 has a tapered portion 35 formed into a porous filter of diameter 2–10$\mu$ having a liquid permeability, said tapered portion being formed of a sintered alloy and having an addition conductor 36 attached to the forward end thereof.

Figure 7:
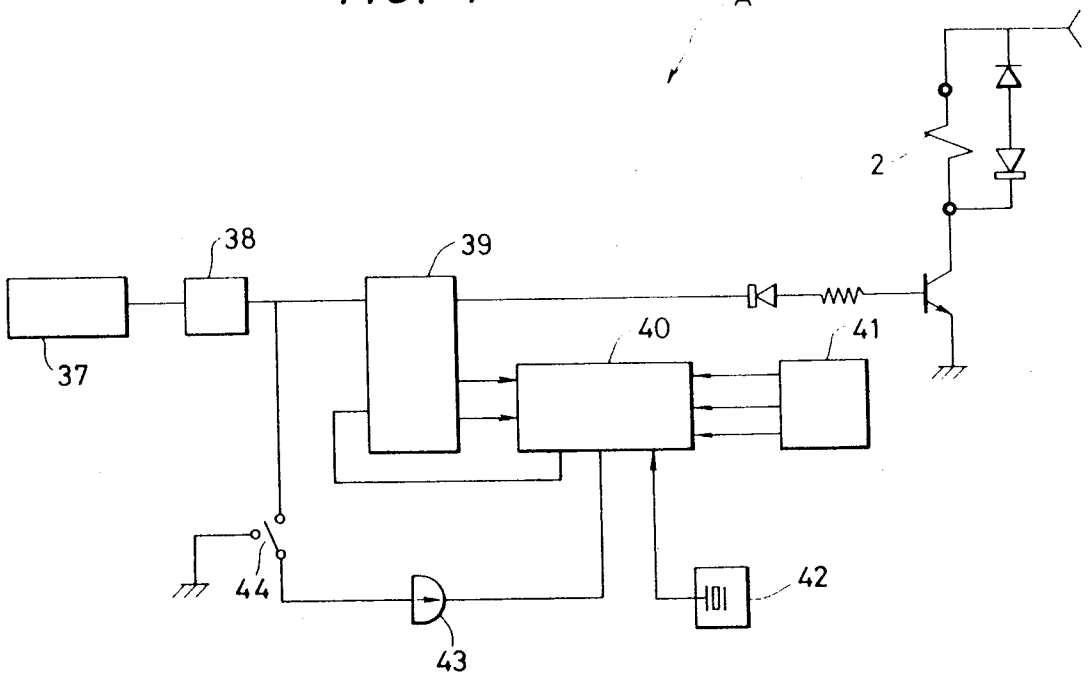
FIG. 7 is a block diagram of a control circuit for dropping liquefied gases.

FIG. 7 shows a control circuit A for dropping liquefied inert gases, and reference numeral 37 designates a can sensor for sensing a passage of can to feed a sensed signal, the sensor comprising a phototube, a proximity switch and the like.

The signal sensed by the can sensor 37 is differentiated by a differenciating circuit 38 and fed to a flip-flop circuit 39. The flip-flop circuit 39 is connected to the electromagnetically-driven device 2 and a counter 40, which is connected to a setter 41, an oscillator 42 and a timer 43. Reference numeral 44 denotes a change-over switch for selecting continuous opening or intermittent opening of the dropping valve 3.

The adjustment of dropping amount of liquefied gases is carried out by controlling internal pressure of the storage tank 1 constant in the control device 17, setting the setter 41 of the control circuit A to a predetermined time and adjusting the time during which the dropping time is open. However, application thereof to a high speed line (for example, more than 600 cans/-min.) to which the responsive speed of the dropping valve 3 cannot follow is carried out by switching the switch 44 of the control circuit A to continuous-open to continuously open the dropping valve 3. In this case, the adjustment of dropping quantity is carried out by controlling internal pressure of the storage tank 1 and mounting the nozzle plate 4' of a suitable nozzle diameter and the pressure erasing nozzle 31. Alternatively, the internal pressure of the can with liquefied gases filled is measured by a can internal-pressure detector 45, during which measurement the dropping quantity of liquefied gases may be adjusted by feeding back the measured value.

It is necessary to make the quantity of sealed liquefied gases constant in order to stabilize internal pressure of the can. However, it is difficult to prevent that pressure within the tank 1 exerts on the flowing-down liquefied gases which flow down at high speeds from the nozzle 6 and impinge upon and scattered from the filler within the can. If the pressure erasing nozzle 31 is used, it is possible to erase said pressure but since the flowing-down liquefied gases stay within the erasing nozzle 31 for a while, such a use of the nozzle 31 will be recommended in case of continuous dropping but is not suitable in case of intermittent dropping.

Figure 8:
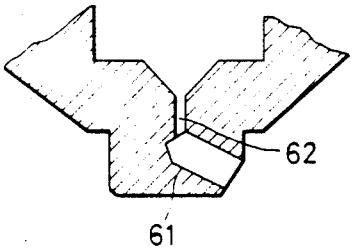
FIGS. 8 and 9 are enlarged sectional views of another embodiments of the dropping nozzle.
Figure 9:
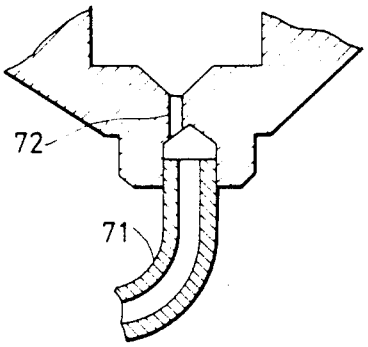

FIGS. 8 and 9 show a modified embodiment of a nozzle for decreasing flow speeds of flowing-down liquefied gases. The nozzle plate shown in FIG. 8 is substantially the same as that shown in FIG. 3 as a whole except the provision of an outlet 62 positioned at the lower part of the nozzle 6, said outlet having an impinging surface 61 inclined thereto. With this, the liquefied gases which flow down through the nozzle 6 impinge upon the impinging surface 61 to lose kinetic energy thus lowering the outflow speed.

In another embodiment shown in FIG. 9, the nozoutlet has a nozzle pipe 71, which is positioned eccentric with respect to the outlet 72 so that the flowing-down liquefied gases once impinge upon the upper end of the nozzle pipe 71 to lose kinetic energy, after which they flow down through the nozzle pipe 71. By decreasing the flow-down speed as mentioned above, it becomes possible to prevent scattering at the time of filling and to stabilize the amount of filling.

What is claimed is:

1. An apparatus for dropping liquefied inert gases into a can immediately before rolling of a canning can, comprising a storage tank for liquefied inert gases, a valve for dropping liquefied gases opened and closed by a driving device, a dropping nozzle for dropping liquefied gases from said dropping valve, a pressure regulating valve provided on a discharge route of vaporized gases above said storage tank, and a float valve adapted to open and close a liquid feed port for the liquefied gases to said storage tank.

2. An apparatus for dropping liquefied gases according to claim 1, wherein the driving device for the dropping valve includes a setter for setting dropping time and is driven by a control circuit actuated by a detection signal of a can.

3. An apparatus for dropping liquefied gases according to claim 1, wherein the dropping nozzle for liquefied gases includes a nozzle plate, and a nozzle for releasing vaporized gases above the liquefied gas storage tank is provided in the outer peripheral portion of said nozzle plate.

4. An apparatus for dropping liquefied gases according to claim 1, wherein the internal surfaces of the storage tank are coated with TEFLON.

5. An apparatus for dropping liquefied gases according to claim 1, wherein internal pressure of a main tank is set higher than internal pressure of said storage tank, and internal pressure of said main tank is applied to the storage tank through a regulator.

6. An apparatus for dropping liquefied gases according to claim 1, wherein for a supply of liquids from said main tank to said storage tank, a quick charge piping for an initial supply of liquids is arranged parallel to a liquid feed pipe controlled by said float valve.

7. An apparatus for dropping liquefied gases according to claim 1, wherein the liquefied gas dropping valve comprises a needle valve, and a valve rod moved up and down by said driving device for opening and closing said needle valve is formed separately from the needle valve at the forward end thereof.

8. An apparatus for dropping liquefied gases according to claim 1, wherein the storage tank is provided with a guide port for guiding vaporized gases to the driving device of the dropping valve.

9. An apparatus for dropping liquefied gases according to claim 1, wherein a can internal-pressure detector is connected to a control circuit for dropping liquefied gases.

10. An apparatus for dropping liquefied gases according to claim 3, wherein the nozzle plate is formed of a synthetic resin.

11. An apparatus for dropping liquefied gases according to claim 3, wherein a pressure erasing nozzle is mounted on the nozzle plate.

12. An apparatus for dropping liquefied gases according to claim 9, wherein the pressure erasing nozzle has a porous portion having a liquid permeability and has a liquefied gas conductor disposed at the forward end thereof.

* * * * *